United States Patent [19]

Robinett

[11] 4,211,032

[45] Jul. 8, 1980

[54] TOY HOOP DEVICE

[76] Inventor: Ross Robinett, 882 Summerland Ave., San Pedro, Calif. 90731

[21] Appl. No.: 938,852

[22] Filed: Sep. 1, 1978

[51] Int. Cl.[2] ..... A63H 33/02

[52] U.S. Cl. ..... 46/220

[58] Field of Search ..... 46/220, 114, 205, 50, 46/1 R; 273/129 C

[56] References Cited

U.S. PATENT DOCUMENTS

| | | | |
|---|---|---|---|
| 3,494,069 | 2/1970 | Klimko | 46/220 |
| 4,070,791 | 1/1978 | Dill | 46/220 |

FOREIGN PATENT DOCUMENTS

| | | | |
|---|---|---|---|
| 92464 | 7/1910 | Austria | 46/220 |

*Primary Examiner*—Russell R. Kinsey
*Assistant Examiner*—Mickey Yu
*Attorney, Agent, or Firm*—Gary Appel

[57] ABSTRACT

A toy hoop device includes a hoop having a flat, rolling surface, and a roller cage disposed peripherally of the hoop. A handle releasably received into the roller cage is employed to guide the hoop and produce an initial rapid hoop spin, if desired.

When high, rotational hoop speeds are affected, the device can be held aloft and function as a gyroscopic toy.

2 Claims, 5 Drawing Figures

TOY HOOP DEVICE

BACKGROUND OF THE INVENTION

This invention relates to a toy hoop device which is adapted to also function as a gyroscopic toy.

Various toy hoop devices have, in the past, been proposed, and all require the user to exercise a certain amount of skill in their operation. Typical patents covering such devices are disclosed in U.S. Pat. Nos. 1,955,330; 2,738,619; 2,976,645; 2,985,985; 3,078,620; 3,222,818; 3,254,443; 3,676,951; 3,731,425; 3,758,984; 3,939,603; 4,008,542; and 4,020,589.

While such hoop devices may be appropriate for the six to ten year old, younger children below this age range tend to lack the coordination and skill required to control and operate these toys. Also, these younger children tend to have a lower interest and attention span than older children; consequently, such hoop toys become boring after a relatively short time. Also, toys which have separate operating parts tend to be short-lived if any of these parts is mislaid. Furthermore, hoop toys designed for younger children should be safe in the sense that they will not run out of control onto, say, a busy street. Finally, while hoop toys generally are not suitable for indoor play, if an alternative indoor use were available, their effectiveness could be increased.

THE INVENTION

In accordance with the present invention, a toy hoop device comprises a hoop having an outer peripheral surface adapted for rolling along another surface and having means defining a central channel formed around the outer peripheral surface and inwardly therefrom. A bearing cage is displaced by bearings in such central channel for rotational movement relative to the hoop. An outer surface of the bearing cage is recessed below the outer peripheral surface of the hoop so as not to interfere with rolling of the hoop. At least one recess is formed into the bearing cage outer surface. A guide handle having one end configured for being releasably received into the bearing cage recess is provided for enabling a user to control movement of the hoop; whereby, in the slowly rotating mode the hoop is adapted to roll along a surface and be guided the handle; and at higher rotational speeds, the hoop exhibits gyroscopic properties.

DESCRIPTION OF THE PREFERRED EMBODIMENT

Figure 1:
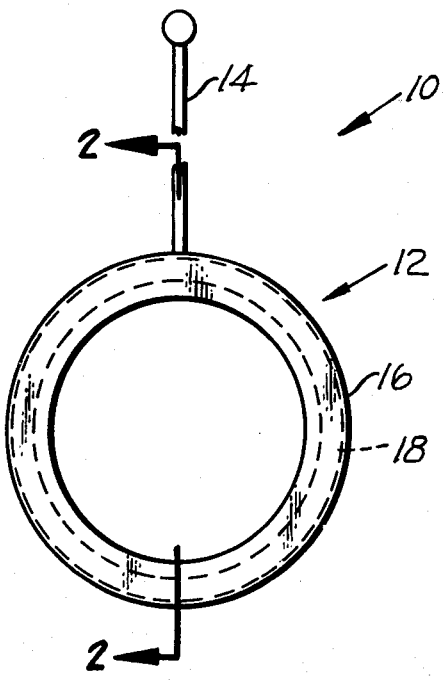
FIG. 1 is an external view in side elevation showing the toy hoop device of this invention.
Figure 2:
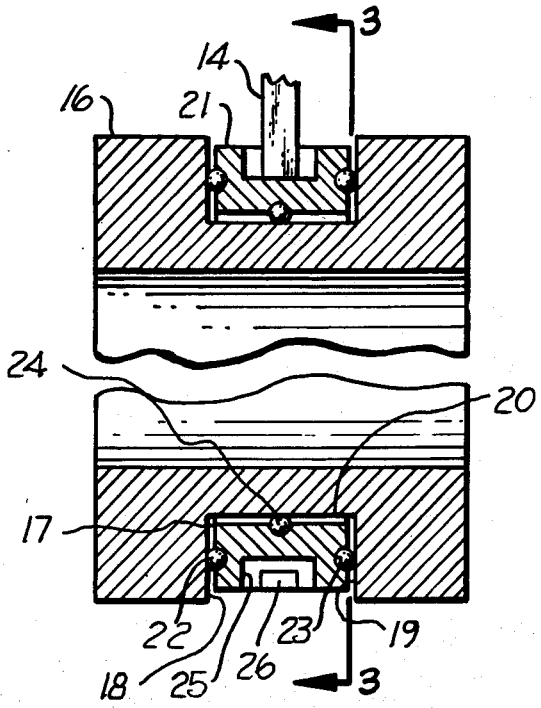
FIG. 2 is an edge elevation view of the hoop in axial section taken along the lines 2—2 of FIG. 1 showing details of the hoop, channel, bearings and roller cage.
Figure 3:
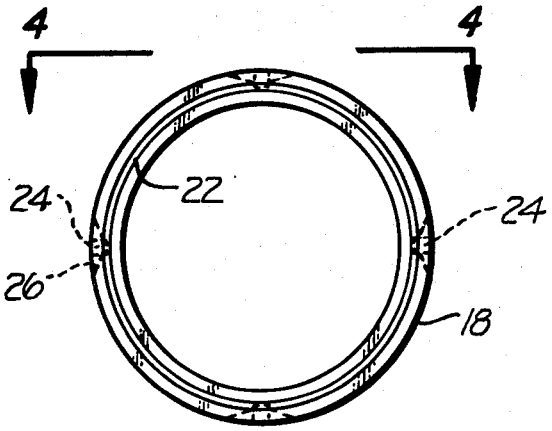
FIG. 3 is a side elevation view of the hoop taken along lines 3—3 of FIG. 2.

The toy hoop device 10 is shown in FIG. 1 and comprises a hoop portion 12 into which is releasably received a guide handle 14. The hoop portion defines a flat peripheral rolling surface 16 and a central channel 17 with sides 18, 19 and a flat trough bottom 20. Disposed within the channel 17 is a bearing cage 21 providing sets of ball bearings 22, 23 and 24 which contact the side walls 18, 19 and trough bottom 20 respectively, two bearing sets being shown in FIG. 2.

Figure 4:
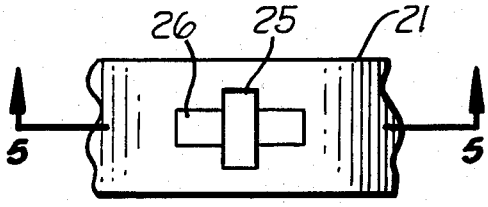
FIG. 4 is an external plan view of the hoop taken along lines 4—4 of FIG. 3; and, FIG. 5 is a side elevation view of the hoop in axial section taken along the lines 5—5 of FIG. 4.
Figure 5:
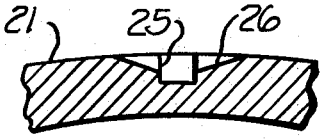

Disposed centrally of a bearing set are recesses 25, 26 into which one end of which the guide handle is placed. As shown in FIGS. 4 and 5, the guide handle may be moved within the recesses 25, 26 to guide the hoop during its operation. The bearings may be nylon, metal, ceramic, etc., while the hoop portion is preferably a plastic such as nylon, polypropylene, etc.

In a freewheeling operation, (with the guide handle not attached) the bearing cage 21 is freely rotatable within channel 17 along bearings 22, 23 and 24. However, when the hoop surface 16 is pressured onto a support surface by means of the guide handle 14 and then given a sudden spin, inertia and rotational energy will be transferred from the bearing cage 21 to the hoop 12 since the received guide handle 14 (being hand held) is prevented from being rotated, and this will prevent rotation of the bearing cage. The rotating hoop can now be placed onto a surface and its movement can be directed by movement of the guide handle 14 within the recesses 25, 26. As an alternative, the moving hoop can be followed or be pushed simply by holding on to the guide handle 14. As a further alternative, the hoop device may be operated simply by rolling without any prior build up of rotational speed.

When functioning as a gyroscopic toy, the hoop surface is pressured onto a support and given a series of sudden spins to build up a very high hoop speed. If, for example, the toy is then inverted and held aloft, the child can operate it as a gyroscopic toy.

It will be appreciated that the toy hoop device of this invention can be employed both by young and more sophisticated older children, whereas most toys designed for very young children are entirely unsuited for an older age group.

I claim:

1. A toy hoop device, which comprises:

(a) a hoop having an outer peripheral surface adapted for rolling along another surface and means defining a central channel formed around said peripheral surface, and inwardly therefrom;

(b) a bearing cage displaced in said central channel for rotational movement relative to said hoop, an outer surface of said cage being recessed below said outer peripheral surface, said cage including means defining at least one recess formed into the cage from said outer surface; and (c) a guide handle having one end configured for being releasably received into said bearing cage recess, to thereby enable a user to control movement of the hoop.

2. The toy hoop device according to claim 1, wherein the bearing cage includes a plurality of bearings disposed between the cage and the hoop in the central channel thereof.

* * * * *